US005190488A

United States Patent [19]

Fujimoto

[11] Patent Number: 5,190,488

[45] Date of Patent: Mar. 2, 1993

[54] OUTBOARD MOTOR

[75] Inventor: Hiroaki Fujimoto, Hamamatsu, Japan

[73] Assignee: Sanshin Kogyo Kabushiki Kaisha, Hamamatsu, Japan

[21] Appl. No.: 661,432

[22] Filed: Feb. 25, 1991

[30] Foreign Application Priority Data

Feb. 26, 1990 [JP] Japan ..... 2-42565

[51] Int. Cl.[5] ..... B63H 5/12

[52] U.S. Cl. ..... 440/53; 440/61; 440/77; 440/89; 440/900

[58] Field of Search ..... 440/53, 57, 58, 59, 440/61, 75, 76, 77, 89, 111, 112, 900

[56] References Cited

U.S. PATENT DOCUMENTS

| | | | |
|---|---|---|---|
| 1,034,987 | 8/1912 | Dacassou | 440/53 |
| 2,091,247 | 8/1937 | Williams | 440/89 |
| 2,335,597 | 11/1943 | Mathewson | 440/58 |
| 2,359,045 | 9/1944 | Markwalder | 440/89 |
| 2,536,894 | 1/1951 | Wanzer | 440/59 |
| 3,070,060 | 12/1962 | Harrison | 440/53 |
| 3,577,952 | 11/1971 | Tado | 440/89 |
| 4,726,799 | 2/1988 | Harada et al. | 440/76 |
| 4,764,134 | 8/1988 | Watanabe | 440/61 |
| 5,088,945 | 2/1991 | Onoue | 440/61 |
| 5,088,946 | 2/1992 | Nakayama | 440/61 |

FOREIGN PATENT DOCUMENTS

| | | | |
|---|---|---|---|
| 279191 | 12/1987 | Japan | 440/75 |
| 326505 | 3/1930 | United Kingdom | 440/53 |

*Primary Examiner*—Sherman Basinger
*Assistant Examiner*—Thomas J. Brahan
*Attorney, Agent, or Firm*—Ernest A. Beutler

[57] ABSTRACT

A outboard motor, for mounting on the transom of a boat, has an engine substantially balanced about the center line of the outboard motor, a horizontally oriented engine output shaft and is angularly tiltable about a horizontal axis forward of the point of attachment of the outboard motor to the transom during operation. The configuration enables the location of the driveshaft housing and lower unit at a point further aft of the transom to keep the marine propulsion unit's center of gravity in a more aftward position, enabling an extended length exhaust system, better control and handling of the exhaust, increased torque, and an increasing overall engine efficiency. The low profile of the marine propulsion unit coupled with its far forward pivot point requires a smaller motor well space and increased visibility in the direction aft of the boat.

17 Claims, 3 Drawing Sheets

OUTBOARD MOTOR

BACKGROUND OF THE INVENTION

This invention relates to an outboard motor, and more particularly, to an improved outboard motor having a compact configuration and one in which the symmetry and balance of the motor is improved.

Conventional outboard motors generally are affixed so that they extend rearwardly of the transom of a watercraft and include a drive shaft housing in which a vertically positioned drive shaft is journaled for driving a propulsion unit in the lower unit to propel the watercraft. An internal combustion engine is normally mounted in a power head above the drive shaft housing and has its output shaft directly coupled to the drive shaft for driving the propulsion unit. Although this type of construction has advantages, it tends to move the center of gravity of the outboard motor to a relatively high location and provides a substantial bulk of the watercraft at a point above the transom where it could interfere with the operator's view. In addition, the high center of gravity causes shifts in the center of gravity of the entire watercraft as the tilt and trim adjustment of the outboard motor is accomplished. Furthermore, the high placement of the powering internal combustion engine can cause it to intrude into the area forward of the transom when the outboard motor is tilted up to an out of the water position.

In addition to the aforenoted defects of conventional type of outboard motors, there are certain other defects which have been overcome by outboard motors having a construction of the type shown in co-pending U.S. letters patent Ser. No. 604,583, filed Oct. 25, 1990 entitled "Marine Propulsion Unit" in the name of Akio Onoue and Ser. No. 604,584, filed Oct. 25, 1990, also entitled "Marine Propulsion Unit" and filed in the name of Manabu Nakayama, both of which applications are assigned to the assignee hereof. Those outboard motors obviate the deficiencies of conventional outboard motors by placing the powering engine substantially forwardly of the transom of the watercraft and extending in a horizontally disposed position so that the engine output shaft rotates about a horizontally disposed axis. However, with the construction shown in those applications, the balance of the powering internal combustion engine is somewhat offset to one side of the outboard motor since the engine output shaft is located coaxially with a horizontally extending shaft of the outboard drive portion of the outboard motor which drives the vertically extending drive shaft. Although such arrangements have certain advantages, there is some advantage to insuring that the center of gravity of the outboard motor lies on the same plane that the drive shaft axis is journaled in. In addition, in order to obtain symmetry with the outboard motor shown in the aforenoted co-pending applications, the induction system is disposed horizontally and in line with the crank case chambers of the engine. In some instances, other forms of induction systems may be required or desirable.

SUMMARY OF THE INVENTION

This invention is adapted to be embodied in an outboard motor for attachment as a unit to the transom of a watercraft and comprises means for affixing the outboard motor to the transom. An internal combustion engine has a horizontally disposed engine output shaft which is laterally displaced from the center line of the outboard motor. A drive shaft housing journals a drive shaft for rotation about a generally vertically extending axis and drives propulsion means at the lower end of the drive shaft housing for propelling a watercraft. Transmission means are provided for driving the drive shaft from the engine output shaft.

DETAILED DESCRIPTION OF THE PREFERRED EMBODIMENT

Figure 1:
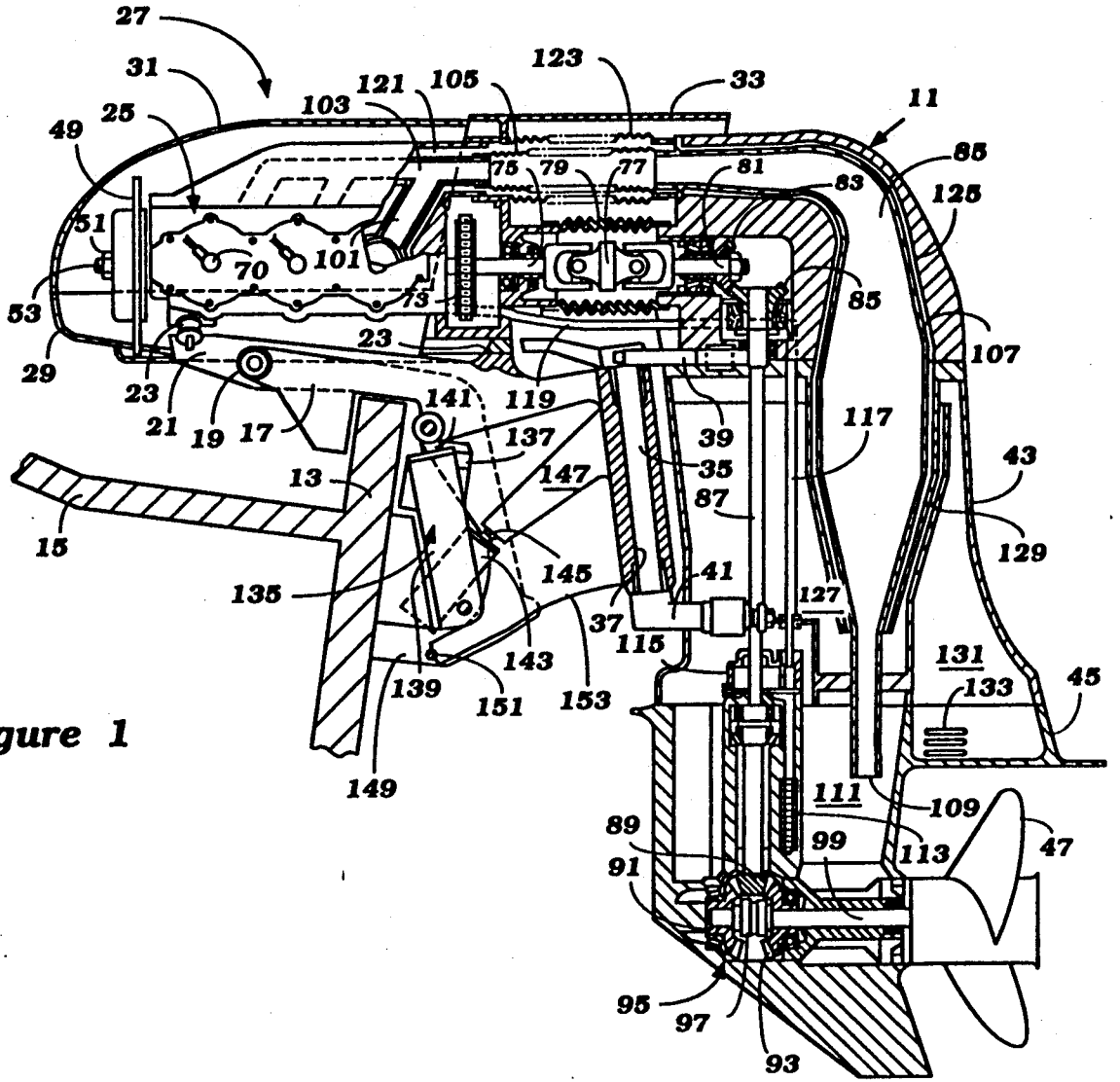
FIG. 1 is a side cross sectional view of the outboard motor of the present invention in its normal running position.
Figure 2:
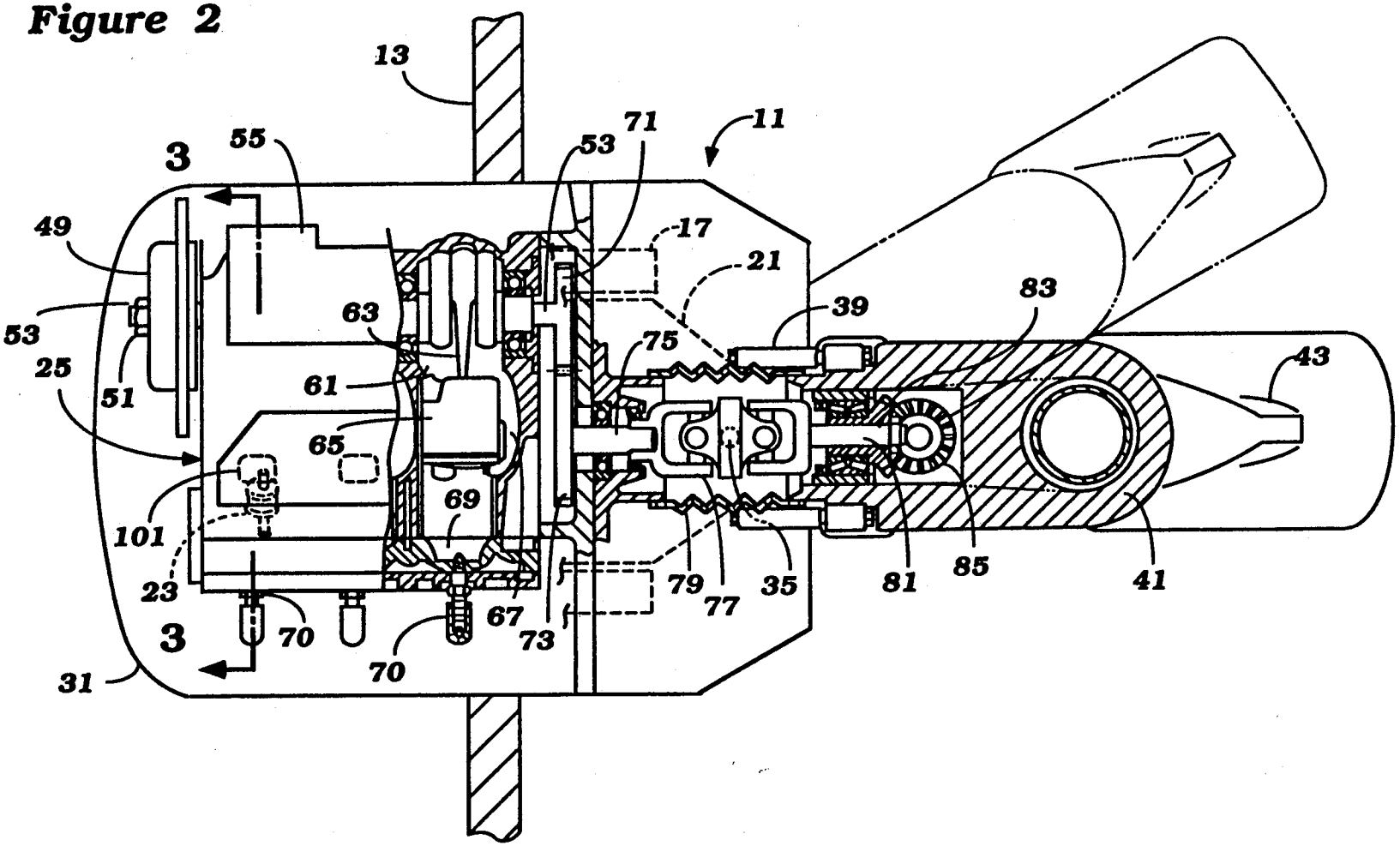
FIG. 2 is a top sectional view of the outboard motor illustrated in FIG. 1.
Figure 3:
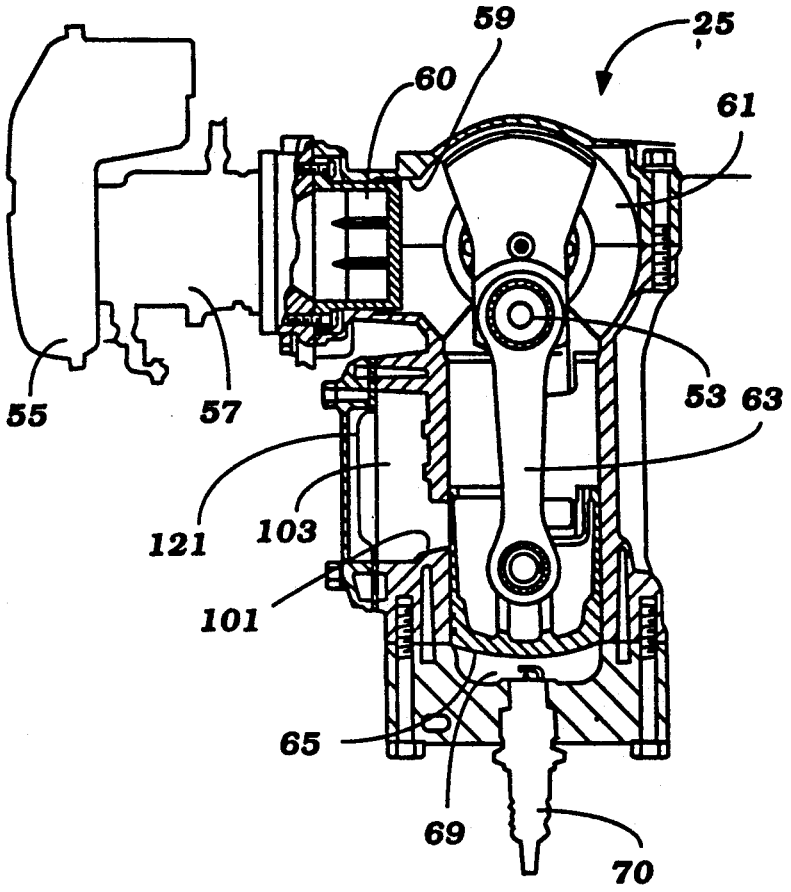
FIG. 3 is a sectional view taken along line 3—3 of FIG. 2.

Referring to FIGS. 1-3, the internal details and configuration of an outboard motor 11 of the present invention will be explained in great detail. The systems of outboard motor 11 cooperate in a synergistic manner to produce an outboard motor having a low profile, low center of gravity, an aftwardly oriented center of gravity, an extended exhaust system having increased efficiency and silencing, and a reduced space requirement. In FIGS. 1 and 2, the outboard motor 11 of the present invention is illustrated in operating position, attached to the transom 13 of a boat. Adjacent transom 13 is a motor well 15. The transom 11 and motor well 15 generally define the space available in a typical boat to accommodate a typical outboard motor.

The systems of outboard motor 11 of the present invention which cooperate to provide a superior outboard motor, include the structural support and steering system, the mechanical power transmission system, the cooling system, the exhaust system, and the tilt system. Each of these systems will be explored in order to familiarize the reader with the manner in which they are cooperatively engaged by the outboard motor 11 of the present invention.

With regard to structural support, outboard motor 11 is adapted to be attached to transom 13 of a boat (not shown). The transom 13 and the motor well 15 not only provide the space within which the outboard motor 11 of the present invention must limit its movement, but must provide support to outboard motor 11. Motor well 15 usually includes side boundaries, as are well known, but they are not illustrated in the figures.

Secured to transom 13 is a clamp bracket 17, which is usually attached to transom 13 by clamps (not shown in the figures). At the forward end of clamp bracket 17, a horizontally extending pin 19 engages a structure which provides support for the engine and which is also known as a swivel bracket 21. Pin 19 is oriented to allow the pivoting engagement, about a horizontal axis, of clamp bracket 17 with swivel bracket 21 at a point significantly forward of transom 13.

The swivel bracket 21 provides support through resilient engine mounts 23 to an engine 25. Engine 25 occupies an area of outboard motor 11 known as the power head which is generally designated by the numeral 27. Swivel bracket 21 also supports an engine cowling 29, an engine hood 31, and a cover 33.

As to the steering system, the swivel bracket 21 also lends structural support to a steering shaft 35 which it supports in a journal 37. The ends of steering shaft 35 are fixed to an upper steering bracket 39 and a lower steering bracket 41, both of which are affixed to a structure known as a driveshaft housing 43 by mounting means. Driveshaft housing 43 is continuous with a lower unit 45 which, in turn, supports a propeller 47. Driveshaft housing 43 and lower unit 45 form the propulsion unit portion of outboard motor 11. This structural arrangement allows driveshaft housing 43 and lower unit 45 to pivot for steering movement with respect to the swivel bracket 21 and the clamp bracket 17.

In the power transmission system, the horizontally oriented engine 25 is depicted as a two-cycle three cylinder type in this engine, although other configurations are possible, and occupies a space previously referred to as the power head 27. As has been previously discussed, engine 25 is supported by resilient supports 23. Engine 25 has a flywheel 49 held in place by a nut 51 on a crankshaft 53. Referring to FIG. 3, the engine 25 has an induction system comprised of a silencer 55 which is connected to vertically extending down draft carburetors 57 which are in turn connected to a reed-type check valve 60 and discharge into an intake manifold 59. Intake manifold 59 is in communication with a crankcase 61, as is typical in the case of a two cycle engine. The crankshaft 53 is suitably journaled within crankcase 61 and is driven by connecting rods 63, which are in turn connected to pistons 65. Pistons 65 cooperate into one or more scavenging ports 67 for each cylinder, which enables engine 25 to receive a combustible mixture from the crankcase into a combustion chamber 69, as is well known for two cycle engines. Spark plugs 70 provide ignition of the combustible mixture in a well known manner.

Referring to FIGS. 1 and 2, note that horizontally oriented crankshaft 53 is displaced from the center of outboard motor 11. Mechanical power is transmitted, during combustion, from the horizontally oriented crankshaft 53 to a first driving gear 71 of a two gear, gear train. First driving gear 71 is drivably connected to a driven gear 73. Apart from any mechanical advantage obtainable by differences in the relative sizes of gears 71 and 73, the central purpose of the gear train is to enable the crankshaft 53 to be laterally displaced, away from the center line of the outboard motor 11, and allow the center of gravity of engine 25 to lie at the center line of outboard motor 11.

As can be seen from FIG. 2, a substantial portion of the mass and volume of engine 25 lies to one side of the center line of the crankshaft 53. If the crankshaft 53 were aligned with the center line of the outboard motor 11, the engine would be displaced to the port side, causing substantially more mass to reside in the port side than in the starboard side. This would cause outboard motor 11 to become significantly unbalanced. In addition, if external volumetric symmetry is to be maintained, the width of the cowling 29 and the hood 31 would have to increase such that an increase in port dimension is matched by an increase in starboard dimension, to result in a much wider space displacement within the motor well 15. This is the exact opposite status of what an efficient superior outboard motor such as outboard motor 11, seeks to occupy. A wider outboard motor 11 requires a larger motor well 15, and does not allow balanced loading about clamp bracket 17 without either the addition of excess mass to counterbalance the mass of engine 25 which would lie port side of the center line of outboard motor 11, or the off center, one-sided placement of clamp bracket 17.

Power from driven gear 73 is transmitted through a horizontally oriented gear-train output shaft 75. Note that the entire engine assembly, including pistons 65, crankshaft 53, and gear train output shaft 75 are horizontally oriented. This horizontal orientation enables engine 25 to be brought almost entirely forward of transom 13 and enables the low profile of outboard motor 11 as is readily seen from FIG. 1. Gear-train output shaft 75 is connected to a generally horizontally oriented universal joint 77. Universal joint 77 is surrounded by a power transmission bellows 79 to provide a flexible protective covering. In FIG. 2, in dashed circle format, the outline of the end of steering shaft 35 is illustrated. So, universal joint 77, as well as steering shaft 35, lies on the steering axis common to the swivel bracket 21 and driveshaft housing 41.

Universal joint 77 is connected to a drive unit input driveshaft 81. At the end of input driveshaft 81 is a bevel gear 83, rotatable about a horizontal axis which engages a bevel gear 85 rotatable about a vertical axis. Bevel gear 85 is connected to one end of driveshaft 87 which extends through and is suitably journaled in driveshaft housing 41. Driveshaft 87 extends into the lower unit 43 where it is connected to a gear 89. Gear 89 engages counter-rotating gears 91 and 93 within a gear box 95.

A clutch 97 is splined to a propeller shaft 99 and couples that shaft to either the gear 91 or 93 for selected forward or reverse drive. Propeller 47 is suitably fixed to propeller shaft 99 and is of a suitable type to make driving engagement with the water, such type dependent upon the load and running conditions of a boat. Note the relative aft displacement of the driveshaft 87 and the driveshaft housing 43, which causes a more aftwardly located center of gravity.

The extended exhaust system of the outboard motor 11 of the present invention is best illustrated with reference to FIG. 1. In communication with each combustion chamber 69 of engine 25 is an upwardly extending exhaust port 101 which is located forward of the transom 13. The exhaust ports 101 join into an exhaust manifold 103. The exhaust manifold 103 opens into an exhaust bellows 105. Exhaust bellows 105 is in communication with an exhaust muffler 107, having a horizontally extending inlet and a vertically extending body and outlet, said outlet labeled as number 109. The central part of muffler 107 forms an expansion chamber. Thus we see that noise is abated both through the right angle turn between the inlet connection with exhaust bellows 105 and the expanded body portion forming the expansion chamber.

Outlet 109 opens into an exhaust chamber 111 which is in communication, through a path not shown, with the center portion of propeller 47. In this manner the exhaust gases are expelled through the inner portion, or hub of propeller 47, typically beneath the water line in order to improve silencing. The extended distance between the exhaust ports 101 and the point where the exhaust gases are expelled through propeller 47 is made possible by bringing the engine 25 forward of the transom 13 while extending the driveshaft housing 43 and lower unit 45 farther aft of the transom 13.

To provide insulatory cooling water for the engine 25 and the exhaust system of the outboard motor 11 of the present invention, a water jacketing system is provided. A water inlet, 113 provides water to a water pump 115. Water pump 115 pumps water through a conduit 117 and through a connected water hose 119. Water hose 119 is in communication with engine 25 through a path not shown, where it supplies water to cool the portions of engine 25 subject to heating.

The cooling water exits engine 25 through a water jacket 121 which somewhat annularly surrounds exhaust manifold 103. The passage formed by water jacket 121 is connected to an adjacent annular passage formed by a water bellows 123. This annular passage between water bellows 123 and exhaust bellows 105 is connected to an annular water passage 125 surrounding muffler 107. Water passage 125 is in communication with a water chamber 127. Water chamber 127 also comprises a transition passage 129 surrounding the aft portion of the passage 125 and communicates with an exit chamber 131. Exit chamber 131 contains a plurality of exit openings 133 through which the spent cooling water is expelled, thus completing its path through the cooling system.

The tilt and trim system is adjacent transom 13. A power tilt device is generally designated as 135. Power tilt device 135 has an electric motor 137 driving an oil pump (not shown) included in the power tilt device 135. Electric motor 137 is situated atop power tilt device 135. Adjacent electric motor 137 and connected to clamp bracket 17, at a point near the housing of power tilt device 135 is a tilt cylinder 139, having a tilt cylinder rod 141 pivotally attached to the upper inside portion of the swivel bracket 21. Laterally adjacent the lower portion of tilt cylinder 135 is a trim cylinder. 143 attached to power tilt device 135. Trim cylinder 143 has a trim cylinder rod 145 which makes contact with an arm 147 which is also shaped in a body with a portion of swivel bracket 21.

Note that tilt cylinder 139 is angled differently than trim cylinder 143. The tilt cylinder 139 is positioned to swing driveshaft housing 43, lower unit 45 and swivel bracket 21 to a wide angle to an out of the water storage position. Trim cylinder 143 provides narrow angled trimming adjustment. Trimming adjustment is a fine adjustment made usually during cruise to achieve optimal fine angle adjustment of the lower unit 45 to adjust the quality of ride or select optimum angle of thrust of lower unit 45 for the most efficient operation. The most efficient operation will dictate a fine, or trimming adjustment based upon the loading and distribution of the loading within a boat.

Adjacent transom 13 near the base of power tilt device 135 is provided a structural member 149 of clamp bracket 17 having a stopping pin 151. An arm 153 attached to swivel bracket 21 rests against stopping pin 151 and provides a limit from which both trim cylinder 143 and tilt cylinder 139 begin to provide a range of movement of the swivel bracket 21 and the driveshaft housing 43, lower unit 45 and engine 25, with respect to clamp bracket 17. Tilt cylinder 139 also provides a shock absorbing function. When the boat is in forward motion, the tilt cylinder 39 acts as a shock absorber with respect to objects encountered by lower unit 45. In reverse, tilt cylinder 139 provides resistance to the rearward thrust of the lower unit 45.

The manner of trimming and tilting of outboard motor 11 has certain advantages best illustrated in the above mentioned co-pending U.S. patent application Ser. Nos. 07/604,583 and 07/604,584. Both of these co-pending applications disclose a trimming and tilting system. In one case, the engine is stationary and only the lower unit tilts and trims, while in the other case, the engine and lower unit tilts and trims about a point far forward of the transom. The advantages of the present invention is equally utilizable on either of the outboard marine propulsion units disclosed in either of the aforementioned co-pending applications. Other advantages more fully set out in that co-pending application include, the advantage of a low center of gravity and a forward pivot point for tiltable movement.

Referring to FIG. 1, it can be seen that the driveshaft 87 and driveshaft housing 43 generally, are displaced far aft of transom 13. The rearward displacement of driveshaft 87 and driveshaft housing 43 is enabled by the forward and horizontal orientation of engine 25, its crankshaft 53 and horizontally oriented drive-train output shaft 75. In conventional outboard motors, the engine has a vertical output shaft and must be located directly over its driveshaft, which practically limits the extent of the rearward location of the driveshaft 87 and driveshaft housing 43. The configuration of the outboard motor 11 of the present invention also facilitates the utilization of an extended exhaust and cooling water passage which improves silencing. In a conventional outboard motor, the exhaust passage has limitations based upon the shortened length of the unit. However, the outboard motor 11 of the present invention has a much longer exhaust passage to facilitate the tunable adjustment of its dimension to match the frequency and throughput of the exhaust gases from engine 25. It is known that exhaust gas output creates back pressure on an engine both due to the total flowing pressure drop and to the resonance set up due to the noisiness of the exhaust. This is particularly true in two cycle engines such as the ones used in outboard motors, and of the engine utilized for outboard motor 11 as presented here. A longer available exhaust path presents the opportunity to adjust the volume configuration in order to "tune" the exhaust path to improve the operating characteristic of the engine. The tuning of the exhaust path facilitates a lessened back pressure on the engine to provide greater efficiency and increased silencing.

In addition, the outboard motor 11 of the present invention tilts about a point significantly forward of transom 13 and does not steer the engine 25 from side to side, which enables the design of a boat having a smaller motor well 15 which will derive the benefit of saving space, or the utilization of the space for other purposes. The utilization of outboard motor 11 of the present invention may spawn a class of boats having smaller motor wells with more space provided for other uses.

The foregoing disclosure and description of the invention is illustrative and explanatory of a preferred embodiment of the invention, and various changes of the illustrated construction may be made without departing from the spirit and scope of the invention.

What is claimed:

1. An outboard motor for attachment as a unit to the transom of a watercraft comprising means for affixing said outboard motor to the transom, an internal combustion engine having a plurality of cylinders all extending transversely to the watercraft and horizontally disposed and a horizontally disposed engine output shaft at one side of said cylinders, a driveshaft housing journaling a driveshaft for rotation about a generally vertically extending axis, propulsion means at the lower end of said driveshaft housing and driven by said driveshaft for propelling the watercraft, a generally vertically extending steering axis about which at least said driveshaft housing is pivoted for steering of said watercraft, said engine output shaft being laterally offset from a longitudinally extending plane containing said steering axis with said plane intersecting said cylinders, and, transmission means for driving said driveshaft from said engine output shaft.

2. The outboard motor as set forth in claim 1 wherein said propulsion means is angularly pivotable about a horizontal axis with respect to said means for affixing.

3. The outboard motor as set forth in claim 2 wherein the driveshaft housing is pivotally connected relative to the engine for pivotal movement about the generally vertically extending steering axis.

4. The outboard motor as set forth in claim 3 wherein the means for driving said driveshaft from said engine output shaft further comprises a universal joint having a pivot axis lying on said generally vertically extending steering axis.

5. The outboard motor as set forth in claim 1 wherein the transmission means for driving said driveshaft from said engine output shaft further comprises a gear train driven by said engine output shaft, and driving a horizontal gear train output shaft in driving connection with said driveshaft.

6. The outboard motor as set forth in claim 1, wherein the engine is disposed substantially forwardly of the transom.

7. The outboard motor as set forth in claim 6 wherein the steering axis is positioned rearwardly of the transom.

8. The outboard motor as set forth in claim 7 wherein said propulsion means is angularly pivotable about a horizontal axis with respect to said means for affixing.

9. The outboard motor as set forth in claim 8 wherein the internal combustion engine is also pivotal about the horizontal axis along with the propulsion unit.

10. The outboard motor as set forth in claim 8 wherein the transmission means for driving said driveshaft from said engine output shaft further comprises a gear train driven by said engine output shaft, and driving a horizontal gear train output shaft in driving connection with said driveshaft.

11. The outboard motor as set forth in claim 10 wherein the driveshaft housing is pivotally connected relative to the engine for pivotal movement about the generally vertically extending steering axis.

12. The outboard motor as set forth in claim 11 wherein the means for driving said driveshaft from said engine output shaft further comprises a universal joint having a pivot axis lying on said generally vertically extending steering axis.

13. The outboard motor as set forth in claim 1 wherein the engine comprises a two cycle, crankcase compression internal combustion engine.

14. The outboard motor as set forth in claim 13 further including an induction system for delivering a charge to the crankcase of the engine, said induction system being offset from the plane containing the steering axis.

15. The outboard motor as set forth in claim 14 wherein the induction system is generally vertically disposed above the crankcase.

16. The outboard motor as set forth in claim 15 wherein said propulsion means is angularly pivotable about a horizontal axis with respect to said means for affixing.

17. The outboard motor as set forth in claim 16 wherein the internal combustion engine is also pivotal about the horizontal axis along with the propulsion unit.

* * * * *